US006176942B1

(12) United States Patent
Clark et al.

(10) Patent No.: US 6,176,942 B1
(45) **Date of Patent: *Jan. 23, 2001**

(54) SOLVENT MIXTURE FOR USE IN A VAPOR DEGREASER AND METHOD OF CLEANING AN ARTICLE IN A VAPOR DEGREASER UTILIZING SAID SOLVENT

(75) Inventors: Lawrence A. Clark, Alameda, CA (US); James L. Priest, Chicago, IL (US)

(73) Assignee: Lawrence Industries, Inc, Alameda, CA (US)

( * ) Notice: Under 35 U.S.C. 154(b), the term of this patent shall be extended for 0 days.

This patent is subject to a terminal disclaimer.

(21) Appl. No.: 09/375,089

(22) Filed: Aug. 16, 1999

Related U.S. Application Data

(63) Continuation of application No. 08/894,495, filed as application No. PCT/US97/05183 on Nov. 10, 1997, now Pat. No. 5,938,859, which is a continuation-in-part of application No. 08/580,840, filed on Dec. 29, 1995, now Pat. No. 5,616,549.

(51) Int. Cl.[7] ..... C11D 7/30; C11D 7/24; C11D 7/26; B08B 3/08

(52) U.S. Cl. ..... 134/31; 134/11; 134/12; 134/19; 134/30; 134/38; 134/40; 510/412; 510/255; 510/256; 510/264; 510/273; 510/365; 510/461; 510/175; 510/266; 252/364

(58) Field of Search ..... 134/11, 12, 19, 134/30, 31, 38, 40; 510/412, 255, 256, 264, 273, 365, 461, 175, 266, 364

(56) References Cited

U.S. PATENT DOCUMENTS

| | | | |
|---|---|---|---|
| 2,371,645 | 3/1945 | Aitchison | 134/31 |
| 3,730,904 | 5/1973 | Clementson et al. | 252/171 |
| 3,881,949 | 5/1975 | Brock | 134/31 |
| 4,056,403 | 11/1977 | Cramer et al. | 134/22 R |
| 4,107,077 | 8/1978 | Sullivan, Jr. et al. | 252/408 |
| 4,135,878 | 1/1979 | Bishop et al. | 8/139 |
| 4,189,397 | 2/1980 | Allen | 252/171 |
| 4,193,838 | 3/1980 | Kelly et al. | 162/5 |
| 4,394,284 | 7/1983 | Pryor | 252/153 |
| 4,652,389 | 3/1987 | Moll | 252/90 |
| 4,828,569 | 5/1989 | Heath et al. | 8/137 |
| 4,898,893 | 2/1990 | Ashida | 521/131 |
| 5,085,365 | 2/1992 | Turner | 228/223 |
| 5,102,573 | 4/1992 | Han et al. | 252/153 |
| 5,190,678 | 3/1993 | Swartz et al. | 252/18 |
| 5,204,169 | 4/1993 | York | 428/220 |
| 5,220,936 | 6/1993 | Pfahl, Jr. et al. | 134/108 |
| 5,302,313 | 4/1994 | Asano et al. | 252/171 |
| 5,320,683 | 6/1994 | Samejima et al. | 134/40 |
| 5,403,507 | 4/1995 | Henry | 252/170 |
| 5,492,645 | 2/1996 | Oshima et al. | 252/171 |
| 5,616,549 * | 4/1997 | Clark | 510/412 |
| 5,665,170 | 9/1997 | Lee et al. | 134/19 |
| 5,665,172 | 9/1997 | Oshima et al. | 134/40 |
| 5,665,173 | 9/1997 | Lee | 134/40 |
| 5,669,985 | 9/1997 | Lee et al. | 134/40 |
| 5,679,632 | 10/1997 | Lee et al. | 510/412 |
| 5,690,862 | 11/1997 | Moore, Jr. et al. | 252/364 |
| 5,792,277 | 8/1998 | Shubkin et al. | 134/19 |
| 5,938,859 * | 8/1999 | Clark et al. | 134/31 |

FOREIGN PATENT DOCUMENTS

| | | |
|---|---|---|
| 350 316 A1 | 1/1990 | (EP) . |
| 2 732 963 | 10/1996 | (FR) . |
| 1 276 783 | 6/1972 | (GB) . |
| 02135296 | 5/1990 | (JP) . |
| 02185597 | 7/1990 | (JP) . |
| 03097793 | 4/1991 | (JP) . |
| 6-128591 | 1/1994 | (JP) . |
| 7-150196 | 6/1995 | (JP) . |
| 7-150197 | 6/1995 | (JP) . |
| 7-292393 | 11/1995 | (JP) . |
| 7-310097 | 11/1995 | (JP) . |
| 8-067643 | 3/1996 | (JP) . |
| 97/16524 | 5/1997 | (WO) . |
| 97/16583 | 5/1997 | (WO) . |

OTHER PUBLICATIONS

Kirk–Othmer, Enclyopedia of Chemical Technology, 4th ed., John Wiley and Sons, pp. 569, 570, 574, 575 (Month of publication is unknown).

Written Opinion dated Jan. 27, 1999 in International Application No. PCT/US97/05183 filed Mar. 28, 1997.

* cited by examiner

*Primary Examiner*—Zeinab El-Arini

(74) *Attorney, Agent, or Firm*—Marshall, O'Toole, Gerstein, Murray & Borun

(57) ABSTRACT

The invention provides a solvent mixture including n-propyl bromide, a mixture of low boiling solvents and, preferably, a defluxing and/or ionics removing additive and/or at least one saturated terpene. The invention also provides a method of cleaning an article (e.g., an electrical, plastic, or metal part) in a vapor degreaser using the solvent mixture. The solvent mixture of the invention is non-flammable, non-corrosive, and non-hazardous. In addition, it has a high solvency and a very low ozone depletion potential. Thus, using the solvent mixture of the invention, oil, grease, rosin flux, and other organic material can be readily removed from the article of interest in an environmentally safe manner.

22 Claims, No Drawings

SOLVENT MIXTURE FOR USE IN A VAPOR DEGREASER AND METHOD OF CLEANING AN ARTICLE IN A VAPOR DEGREASER UTILIZING SAID SOLVENT

CROSS-REFERENCE TO RELATED APPLICATION

This is a continuation of U.S. application Ser. No. 08/894,495 filed Nov. 10, 1997, now U.S. Pat. No. 5,938,859 issued Aug. 17, 1999, which is the U.S. national phase of International Application No. PCT/US97/05183 filed Mar. 28, 1997, which is a continuation-in-part of U.S. application Ser. No. 08/580,840 filed Dec. 29, 1995, now U.S. Pat. No. 5,616,549 issued Apr. 1, 1997.

FIELD OF THE INVENTION

The invention relates generally to molecular level cleaning of parts by vapor degreasing. More particularly, the invention relates to a solvent mixture comprising n-propyl bromide, a mixture of low boiling solvents and, preferably, a defluxing and/or ionics removing agent and/or at least one saturated terpene, as well as to a method of cleaning an article in a vapor degreaser using the solvent mixture. The solvent mixture of the invention is non-flammable, non-corrosive, non-hazardous, and has a low ozone depletion potential.

BACKGROUND OF THE INVENTION

Molecular level cleaning by vapor degreasing has found wide acceptance in industry. In fact, molecular level cleaning by vapor degreasing is a preferred method of cleaning precision parts, such as electronics, machined metallic parts, etc., since vapor cleaning leaves virtually no residue on the parts. Generally, vapor degreasing involves the heating of a solvent to its boiling point to generate a vapor layer into which the object to be cleaned is placed. The vapor condenses on the object and subjects the surface to a solvent-flushing action as it flows downward. The solvent-flushing action dissolves the hydrocarbon contaminants and removes them from the object, thereby cleaning it. The liquid drops are then collected in a reservoir and are revaporized, typically through the use of steam-heating coils. Thus, the surface of the object is continually rinsed with fresh solvent.

There are four general types of vapor phase degreasers. The simplest form of a vapor phase degreaser is the straight vapor cycle degreaser which utilizes only the vapor for cleaning. As the parts are lowered into the hot vapor, the vapor condenses on the cold parts and dissolves the surface oils and greases. The oily condensate drops back into the liquid solvent at the base of the tank. The solvent is evaporated continuously to form a vapor blanket. Since the oils are not vaporized, they remain in the bottom of the tank in the form of a sludge. The scrubbing action of the condensing vapor continues until the temperature of the part reaches the temperature of the vapor whereupon condensation ceases, the part appears dry, and it is removed from the degreaser. The time required to reach this point depends on the particular solvent employed, the temperature of the vapor, the weight of the part, its specific heat and the type of contamination material to be removed. This particular vapor phase degreaser does an excellent job of drying parts after aqueous cleaning and before plating and, thus, it is frequently used for this purpose in the jewelry industry. Unfortunately, however, it is not as effective on small, light weight parts because such parts frequently reach the temperature of the vapor before the condensing action has fully cleaned the parts.

A second type of vapor phase degreaser, i.e., the vapor-spray cycle degreaser, is frequently used to solve the problems associated with the straight vapor cycle degreaser. In this vapor-spray cycle degreaser, the part to be cleansed is first placed in the vapor zone as is done in the straight vapor cycle degreaser. A portion of the vapor is condensed by cooling coils and fills a liquid solvent reservoir. This warm liquid solvent is pumped to a spray nozzle that can be used to direct the solvent on the part, washing off surface oils and cooling the part, thereby cleaning by vapor condensation.

The third type of vapor phase degreaser is a liquid-vapor cycle degreaser which has one compartment with warm solvent and another compartment with a vapor zone. This degreaser is particularly useful for heavily soiled parts or for cleaning a basket of small parts that nest together. The fourth type of vapor phase degreaser is the ultrasonic degreaser. Such degreasers are useful for cleaning critical parts. An ultrasonic degreaser has a transducer mounted at the base of the tank which operates in the range of 20 kHz to 40 kHz. The transducer alternately compresses and expands the solvent forming small bubbles which, in turn, cavitate or collapse on the surface of the part. This cavitation phenomenon disrupts the adhering soils, thereby cleaning the part.

Conventional solvents used with the foregoing vapor phase degreasers include trichloroethylene, perchloroethylene, methyl chloroform, methylene chloride, CFC 113, dibromomethane, bromochloromethane, trichlorotrifluoroethane and various hydrochlorofluorocarbons, such as "Genesolve" (manufactured by Allied Chemical). Vapor degreasing techniques employing the foregoing solvents or equivalents thereof are taught in U.S. Pat. No. 3,881,949 which issued on May 6, 1975 to Carl Martin Brock. Unfortunately, however, such solvents are typically on the Clean Air Act list of high ozone depleting chemicals and, thus, they are being phased out of production and/or banned from use in the United States. Thus, there exists a need for a solvent which can be used in place of these banned ozone depleting chemicals in vapor phase degreasers.

U.S. Pat. No. 4,056,403, which issued to Robert J. Cramer, et al. on Nov. 1, 1977, describes a method in which a number of non-regulated ozone depleting chemicals, including n-propyl bromide, are used in cleaning polyurethane foam generating equipment. Cramer, et al. teach a method wherein a solvent composition described therein is used for cleaning a polyurethane foam generating apparatus or a segment thereof. The solvents taught may be periodically injected under pressure through the mixer portion of the foaming apparatus in order to purge it of residual unreacted or partially foam forming materials. Unfortunately, the method described in this patent would be totally ineffective because its composition does not include the appropriate stabilizers necessary to prevent the n-propyl bromide from becoming acid and thereby attacking the metal surfaces which might be placed into the vapor layer.

The use of hot saturated vapors of a liquid halogenated hydrocarbon, including bromochloromethane, is taught in U.S. Pat. No. 4,193,838 which issued to Robert J. Kelly, et al. on Mar. 18, 1990. More particularly, this patent teaches the generation of a pool of hot saturated vapors of a halogenated acyclic hydrocarbon. Pieces of paper stock which have been coated with "hot melt" coatings, such as are used on consumer items and milk cartons, etc., are then placed in the vapor pool and, thereafter, they are agitated. Again, it is noted that this method would be ineffective at cleaning flux and other articles because of the acidic nature of the non-stabilized compound utilized therein which would tend to destroy the object rather than just clean it.

U.S. Pat. No. 5,403,507, which issued to Richard G. Henry on Apr. 4, 1995, discloses a solvent mixture for use in vapor cleaning degreasing. Dibromomethane is used as the principal component. The dibromomethane is mixed with other solvents which are intended to stabilize the dibromomethane and to prevent the solvent mixture from becoming acidic on the release of bromine into the atmosphere. Although the solvent mixture disclosed therein is more stable than either of the solvent mixtures taught in U.S. Pat. Nos. 4,056,403 and 4,193,838, there are still a number of disadvantages associated with the use of dibromomethane which make it unsuitable for use as a solvent in vapor phase degreasers. In fact, the Clean Air Act now lists dibromomethane as an ozone depleting chemical which is banned from use in vapor degreasers or any other cleaning process which results in atmospheric release.

In view of the foregoing, it is readily apparent that there remains a need in the art for a solvent mixture which is suitable for molecular level cleaning of parts without the use of any of the high ozone depleting chemicals that are identified as Class I or Class II materials in the U.S. Federal Register, Vol. 58, No. 236, Friday, Dec. 10, 1993, Rules and bromochloromethane as a potential ozone depleter and possible banning in the U.S. Federal Register 40 CFR Part 82, Vol. 60, No. 145, Pages 38729–38734, Jul. 28, 1995.

SUMMARY OF THE INVENTION

It is an object of the invention to overcome at least one of the problems described above.

Accordingly, the invention provides a solvent mixture which can be used in vapor phase degreasers in place of traditional solvents.

More particularly, the invention provides a solvent mixture for use in a vapor degreasing system, the solvent mixture comprising effective amounts of n-propyl bromide and at least one low boiling solvent or mixture thereof and, preferably, a defluxing and/or ionics removing additive and/or at least one saturated terpene.

In another aspect, the invention provides a method for cleaning an article in a vapor degreaser, the method comprising: (a) providing a vapor degreaser system; (b) adding to the solvent reservoir of the vapor degreaser system the inventive solvent mixture; (c) boiling the solvent mixture to form a vapor layer; (d) introducing into the vapor layer an article to be cleaned; and, (e) removing the article from the vapor layer.

In this method, the vapor layer condenses on the article, thereby subjecting the surface of the article to a solvent-flushing action as it flows downward. The solvent-flushing action dissolves the hydrocarbon contaminants and removes them from the object, thereby cleaning it. As such, using the method of the present invention, oil, grease, rosin flux and other organic material can be readily removed from the article of interest.

Other features, objects, and advantages of the invention and its preferred embodiments will become apparent from a review of the detailed description which follows.

DETAILED DESCRIPTION OF THE INVENTION AND PREFERRED EMBODIMENTS

The solvent mixture of the invention is non-flammable, non-corrosive, and non-hazardous. Moreover, it has a high solvency and a low ozone depletion potential typically between 0.001 and 0.04 and a global warming potential typically between 0.0001 and 0.0003. As such, the solvent mixture of the present invention can effectively be used to remove oil, grease, rosin, flux, and other organic contaminants from the surfaces of numerous articles, e.g., electrical, plastic and metallic parts.

Preferably, the invention provides a solvent mixture for use in a vapor degreasing system, the solvent mixture comprising: (a) about 85 wt. % to less than about 96.5 wt. % n-propyl bromide; (b) 0 wt. % to about 6.5 wt. % of one or a mixture of saturated terpenes, the terpene mixture preferably comprising about 35 wt. % to about 50 wt. % cis-pinane and about 35 wt. % to about 50 wt. % tran-spinane; (c) an effective amount, preferably about 3.5 wt. % to less than about 15 wt. % or about 3.5 wt. % to about 5 wt. % of a mixture of low boiling solvents, the low boiling solvent mixture preferably comprising about 0.5 wt. % to about 1 wt. % nitromethane, about 0.5 wt. % to about 1 wt. % 1,2-butylene oxide, and about 2.5 wt. % to about 3 wt. % 1,3-dioxolane; and, (d) 0 wt. % up to about 5 wt. % of at least one defluxing and/or ionics removing additive selected from the group consisting of sec-butanol, ethanol, and methanol.

In a presently preferred embodiment, the terpene mixture of cis-pinane and trans-pinane includes terpenes. Suitable terpenes include, but are not limited to, one or more of the following: endo-isocamphene, α-pinene, cis-para-menthane and trans-para-menthane. In another preferred embodiment, the terpene mixture further includes endo-isocamphene, α-pinene, cis-para-menthane and trans-para-menthane. If present, these terpenes can, individually, make up to 100% of the terpene content of the solvent mixture and, preferably, about 0.01 wt. % to about 6.5 wt. % of the solvent mixture, and highly preferably about 0.05 wt. % to about 5 wt. % of the solvent mixture.

One of functions of the low boiling solvent or low boiling solvent mixture is to neutralize any free acid that might result from oxidation of the mixture in the presence of air, from hydrolysis of the mixture in the presence of water, and from pyrolysis of the mixture under the influence of high temperatures. Moreover, the low boiling solvent or solvent mixture serves to prevent pitting or corrosion of metal articles which are placed in the vapor layer.

It has been discovered that the solvent mixture of the invention meets the desired characteristics for the proper cleaning of electrical parts, metals, plastics, elastomers, circuit boards, etc. More particularly, the solvent mixture of the invention has the following characteristics: (1) it is properly stabilized against any free acid that might result from oxidation of the mixture in the presence of air, from hydrolysis of the mixture in the presence of water, and from pyrolysis of the mixture under the influence of high temperatures; (2) it is non-flammable and non-corrosive; (3) the various components of the solvent mixture are not regulated by the U.S. Clean Air Act; and (4) none of the various components of the solvent mixture are known cancer causing agents (i.e., the various components are not listed by N.T.I., I.A.R.C. and California Proposition 65, nor are they regulated by OSHA). Moreover, the solvent mixture of the invention has a high solvency with a kauri-butanol value above 120 and, more preferably, above 125. In addition, the solvent mixture of the invention has an evaporation rate of at least 0.96 where that of 1,1,1-trichloroethane=1. Upon evaporation, the solvent mixture of the invention leaves a non-volatile residue (NVR) of less than 2.5 mg (or less than about 500 ppm) and, more preferably, no residue. Further, the solvent mixture of the invention has a latent heat of vaporization of about 58.8 cal/g which, in turn, facilitates condensation of the solvent mixture on the chiller side of a standard vapor degreasing system.

In addition, the use of n-propyl bromide in the solvent mixture of the invention has significant advantages over the use of dibromomethane and bromochloromethane. In contrast to n-propyl bromide, dibromomethane is listed by the Clean Air Act as an ozone depleting chemical which is banned from use in vapor degreasing or other cleaning processes involving atmospheric release and bromochloromethane which is suspect of having a ODP of greater >0.1 where the ODP of the banned 1,1,1-trichloroethane=0.1 and bromochloromethane will not obtain SNAP approval and may be banned. Moreover, in contrast to n-propyl bromide which has an atmospheric life of about 7 to 14 days and an ODP of 0.001–0.04, dibromomethane has an atmospheric life of about three years and bromochloromethane of three to four months and a ODP of 0.08–1.2. Dibromomethane is more toxic than n-propyl bromide and, in contrast to n-propyl bromide, dibromomethane undergoes bioaccumulation (eg., in fish and aquatic life). In addition, while both dibromomethane and n-propyl bromide react with strong bases, strong oxidizing agents, aluminum, calcium, zinc, magnesium, alloys, etc., the compounds formed with dibromomethane are typically shock sensitive and, thus, potentially explosive, whereas those formed with n-propyl bromide are not. Further, the chemical and physical properties of the n-propyl bromide-based solvent mixtures of the invention make them more energy efficient than the bromochloromethane or dibromomethane solvent mixture of the prior art or the banned solvents 1,1,1-trichloroethylene, trichloroethylene, or methylene chloride. As a result of its boiling point, specific heat and latent heat of vaporization, the n-propyl bromide-based solvent mixtures of the invention require about the same or less energy to cause the mixture to boil and create a denser vapor zone for cleaning.

The sec-butanol, ethanol, and/or methanol present in the solvent mixture function(s) as an aid in defluxing and/or in removing ionic species in vapor degreasing and cold batch cleaning operations.

The presence of sec-butanol enhances flux removal for type R, type RMA, type RA, and synthetic fluxes. Sec-butanol also enhances cleaning of polar and non-polar soils including hand oils, solder oils, greases, silicones, and similar soils.

Methanol is effective in enhancing removal of type A and type RMA fluxes. Ethanol, when present, forms an azeotropic mixture with n-propyl bromide, and is specially useful in defluxing soldered metal parts.

The defluxing and/or ionics removing agent or mixture of agents is typically used in an effective amount of up to about 5 wt. %, preferably 3 wt. % or less, and highly preferably about 1 wt. %, based on the total solvent composition.

As a result of the foregoing properties, the solvent mixture of the invention can be advantageously used in vapor phase degreasers in place of traditional solvents including, for example, trichloroethylene, perchloroethylene, methyl chloroform, methylene chloride, trichlorotrifluoroethane, dibromomethane, CFC-113, etc.

Moreover, the solvent mixture of the invention can be effectively used in the four major types of vapor phase degreasers, i.e., the straight vapor cycle degreaser, the vapor-spray cycle degreaser, and the liquid-vapor degreaser and the ultrasonic degreaser. In addition, emissions from a vapor phase degreaser operated with the solvent mixture of the invention are so low that local exhaust ventilation is not required, although in some instances, such a system may still be desirable.

The solvent composition of the invention is simply prepared by combining and mixing together the n-propyl bromide, the terpene mixture (if present), the low boiling solvent mixture, and the defluxing and/or ionics removing agent (if present) in the desired or specified proportions. The solvent mixture is then ready to use as the solvent in a vapor phase degreaser system. n-propyl bromide ($C_3H_7Br$, i.e., $CH_3CH_2CH_2Br$) is commercially available from Dead Sea Bromine LTD Israel. The terpenes used to make up the terpene mixture are commercially available from SCM Glidco Jacksonville Fla. Nitromethane ($CH_3NO_2$), 1,3-dioxolane, and 1,2-butylene oxide (also known as 1,2-epoxybutane) are commercially available from Aldrich Chemical Co. (Milwaukee, Wis.). Sec-butanol is also available from Aldrich Chemical Co. In addition to purchasing the foregoing compounds from commercial sources, it will be apparent to those of skill in the art that such compounds can be readily synthesized using known synthetic procedures. For instance, n-propyl bromide can be prepared, for example, when alcohols react with either inorganic acid halides or with hydrogen halides. (see, e.g., Carl R. Noller, *Textbook of Organic Chemistry.* Ch 6:81 (1956), the teachings of which are incorporated herein by reference for all purposes).

In another aspect, the invention provides a method of cleaning articles in a vapor degreaser using the solvent mixture of the invention. In this method, the solvent mixture of the invention is added to a vapor degreaser, such as Baron-Blakeslee or Branson models. The thermostat on the vapor degreaser is typically set to a temperature of about 156° F. to about 160° F. (Ultrasonic degreasers can operate effectively at temperatures as low as 70° F.) In this temperature range, the n-propyl bromide present in the solvent mixture will boil. When the solvent mixture reaches a temperature of about 156° F. to about 160° F., a vapor layer will appear above the solvent as a mist. This vapor mist constitutes the principal feature of cleaning by the vapor method. When the vapor mist appears, the object to be cleaned is placed into the vapor layer. The vapor condenses on the object and subjects the surface of the object to a solvent-flushing action as it flows downward. The solvent-flushing action dissolves the hydrocarbon contaminants and removes them from the object, thereby cleaning it. The liquid drops are then collected in a reservoir and are revaporized, typically through the use of steam-heating coils. Thus, the surface of the object is continually rinsed with fresh solvent. As such, using the method of the invention, oil, grease, rosin flux and other organic material can be readily removed from the object of interest. Moreover, the vapors from the solvent will not contain any of the removed contaminants and, thus, the vapors can be used to clean additional objects.

The invention will be described in greater detail by way of specific examples. The following examples are offered for illustrative purposes, and are intended neither to limit or define the invention in any manner.

EXAMPLE I

A solvent mixture in accordance with the invention was blended and added together to a standard vapor degreaser, the solvent mixture comprising: (I) about 90.0 wt. % n-propyl bromide; (ii) about 6 wt. % of a mixture of saturated terpenes, the terpene mixture comprising about 45 wt. % cis-pinane, about 45 wt. % trans-pinane, about 2 wt. % endo-isocamphene, about 2 wt. % α-pinene, about 2 wt. % cis-para-menthane and about 2 wt. % trans-para-menthane; and (iii) about 4 wt. % of a mixture of low boiling solvents, the low boiling solvent mixture comprising about 0.5 wt. % nitromethane, about 0.5 wt. % 1,2-butylene oxide and about 3 wt. % 1,3-dioxolane. The thermostat on the vapor degreaser was adjusted to a temperature of about 160° F., and the system was allowed to equilibrate. After the mixture inside the solvent reservoir reached a temperature of about 160° F., the mixture began to boil. Upon inspection, a vapor layer several inches thick was observed inside the vapor degreaser unit. Enough vapor was being evolved to condense and be circulated from the chilled side of the vapor degreaser to the boiling side of the vapor degreaser.

EXAMPLE II

Fifteen gallons of the solvent mixture described in Example I were added to a vapor phase degreaser. The thermostat on the vapor degreaser was adjusted to a temperature of about 160° F., and the system was allowed to equilibrate. After the mixture inside the solvent reservoir reached a temperature of about 160° F., the mixture began to boil. A basket of steel parts covered with lithium-based grease was placed in the vapor layer. After a period of about 30 seconds, the basket of steel parts was removed from the vapor layer. All of the lithium-based grease had been removed and the steel parts were completely clean. Using a similar procedure as that just described, pieces of sheet metal containing light mineral oils, silicone oils, lithium greases, and other types of industrial release fluids were placed in the vapor layer to be cleaned. After a period of about a minute, the pieces of sheet metal were removed from the vapor layer. All of the contaminants, i.e., the light mineral oils, silicone oils, lithium greases, and other types of industrial release fluids, had been removed.

EXAMPLE III

Fifteen gallons of the solvent mixture described in Example I were added to a ultrasonic degreaser, which will operate effectively with the inventive solvent mixture at temperatures in the range of 70° F. to about 160° F. The ultrasonic degreaser had a transducer mounted at the base of the tank which operates in the range of 20 kHZ to 40 kHz. The thermostat on the ultrasonic degreaser was adjusted to a temperature of about 160° F., and the system was allowed to equilibrate. The ultrasonic degreaser also employed water chilled coils to control the solvent vapors and to eliminate the need for a local exhaust ventilation system. Several steel parts coated with lithium grease were immersed in the solvent for about one minute. The transducer alternately compressed and expanded the solvent thereby forming small bubbles which, in turn, cavitated at the surface of the lithium grease coated steel parts. The cavitation phenomenon disrupted the adhering soils and cleaned the parts. Using a similar procedure as that just described, pieces of sheet metal containing light mineral oils, silicone oils, lithium greases, and other types of industrial release fluids were immersed in the ultrasonic degreaser. After a period of about a minute, the pieces of sheet metal were removed from the vapor layer. All of the contaminants, i.e., the light mineral oils, silicone oils, lithium greases, and other types of industrial release fluids, had been removed.

EXAMPLE IV

Five gallons of the solvent mixture described in Example I were added to an emulsion soak tank. A steel part coated with lithium grease was immersed for one minute into an emulsion soak tank containing the solvent mixture at room temperature. While some cleaning occurred, the resulting cleaning was not at the molecular level. Similarly, five gallons of the solvent mixture described in Example I were added to a heated power washer emulsion degreaser. The thermostat on this degreaser was adjusted to 156° F., just below the boiling point of n-propyl bromide, and the system was allowed to equilibrate. Thereafter, the solvent mixture was sprayed on steel parts which were coated with lithium grease. Upon inspection, it was observed that the resulting cleaning was at the molecular level.

EXAMPLE V

Standard corrosion tests, similar to those performed by Dow Chemical Company, were performed using the solvent mixture of the invention, as oxidation is a potential problem with all solvent cleaners. In addition, methodology similar to that used by Dow Chemical Company was used to show equilivences to existing Clean Air Act banned solvents. In performing these test, strips of copper and steel measuring 1" wide by 6" long and of 20 mil thickness were buffed on a belt sander to remove any oxide films. Fifty milliliters of the solvent mixture described in Example I were placed in a cylindrical Pyrex glass container and strips were placed in so that 75% of the surface was immersed in the solvent. A sample container filled with tap water was used as a control for the test to insure that there were no alloys present in the metal strips which would have been prevented oxidation. The openings of the sample containers were all sealed with cork stoppers to reduce evaporation. After an eight hour incubation period and a 24 hour incubations period, the strips were removed and it was determined that the solvent mixture of the present invention was non-corrosive.

It is to be understood that the above description is intended to be illustrative and not restrictive. Many embodiments may be apparent to those of skill in the art upon reading the above description. The scope of the invention should, therefore, be determined not with reference to the foregoing description, but should instead be determined with reference to the appended claims, along with the full scope of equivalents to which such claims are entitled. The disclosures of all articles and references, including patent applications and publications, are incorporated herein by reference for all purposes.

What is claimed is:

1. A solvent mixture for use in a vapor degreasing system, said solvent mixture comprising:

(a) about 85 wt. % to less than about 96.5 wt. % n-propyl bromide;

(b) about 3.5 wt. % to less than about 15 wt. % of a mixture of low boiling solvents, said mixture of low boiling solvents comprising about 0.5 wt. % to about 1 wt. % nitromethane, based on the solvent mixture, about 0.5 wt. % to about 1 wt. % 1,2-butylene oxide based on the solvent mixture, and the balance of said mixture of low boiling solvents being 1,3-dioxolane; and (c) an effective amount of up to about 5 wt. % of at least one additive selected from the group consisting of sec-butanol, ethanol, and methanol, provided that sec-butanol comprises 0 wt. % to about 3 wt. % of said solvent mixture.

2. The solvent mixture of claim 1 further comprising an effective amount of at least one saturated terpene.

3. The solvent mixture of claim 2 comprising up to about 6.5 wt. % of a terpene mixture of cis-pinane and trans-pinane.

4. The solvent mixture of claim 3 wherein said terpene mixture comprises about 35 wt. % to about 50 wt. % cis-pinane and about 35 wt. % to about 50 wt. % tran-spinane.

5. The solvent mixture of claim 2 wherein said terpene mixture further comprises at least one terpene selected from the group consisting of endo-isocamphene, α-pinene, cis-para-menthane, and trans-para-menthane.

6. The solvent mixture of claim 2 wherein said terpene mixture further comprises endo-isocamphene, α-pinene, cis-para-menthane, and trans-para-menthane.

7. The solvent mixture of claim 1 wherein said additive consists essentially of up to about 3 wt. % of sec-butanol.

8. The solvent mixture of claim 7 wherein said sec-butanol comprises about 1 wt. % of said solvent mixture.

9. The solvent mixture of claim 1 comprising about 3.5 wt. % to about 5 wt. % of said mixture of low boiling solvents.

10. A method for cleaning an article having a surface in a vapor degreaser, said method comprising:

(a) providing a vapor degreaser system having a solvent reservoir;

(b) adding to the solvent reservoir of said vapor degreaser system a solvent mixture, said solvent mixture comprising:

i) about 85 wt. % to less than about 96.5 wt. % n-propyl bromide;

ii) about 3.5 wt. % to less than about 15 wt. % of a mixture of low boiling solvents, said mixture of low boiling solvents comprising about 0.5 wt. % to about 1 wt. % nitromethane, based on the solvent mixture, about 0.5 wt. % to about 1 wt. % 1,2-butylene oxide, and the balance of said mixture of low boiling solvents being 1,3-dioxolane; and iii) an effective amount of up to about 5 wt. % of at least one additive selected from the group consisting of sec-butanol, ethanol, and methanol, provided that sec-butanol comprises 0 wt. % to about 3 wt. % of said solvent mixture;

(c) boiling said solvent mixture to form a vapor layer;

(d) introducing into said vapor layer said article to be cleaned, said vapor layer condensing on a surface of said article, thereby subjecting the surface of said article to a solvent-flushing action; and (e) removing said article from said vapor layer.

11. The method of claim 10 further comprising an effective amount of at least one saturated terpene.

12. The method of claim 11 comprising up to about 6.5 wt. % of a terpene mixture of cis-pinane and trans-pinane.

13. The method of claim 12 wherein said terpene mixture comprises about 35 wt. % to about 50 wt. % cis-pinane and about 35 wt. % to about 50 wt. % trans-pinane.

14. The method of claim 11 wherein said terpene mixture further comprises a terpene selected from the group consisting of endo-isocamphene, α-pinene, cis-para-menthane and trans-para-menthane.

15. The method of claim 11 wherein said terpene mixture further comprises endo-isocamphene, α-pinene, cis-para-menthane and trans-para-menthane.

16. The method of claim 10 wherein said additive consists essentially of up to about 3 wt. % of sec-butanol.

17. The method of claim 16 wherein said sec-butanol comprises about 1 wt. % of said solvent mixture.

18. The method of claim 10 wherein said solvent mixture comprises about 3.5 wt. % to about 5 wt. % of said mixture of low boiling solvents.

19. A solvent mixture for use in a vapor degreasing system, said solvent mixture comprising:

(a) about 85 wt. % to less than about 96.5 wt. % n-propyl bromide;

(b) about 3.5 wt. % to less than about 15 wt. % of a mixture of low boiling solvents, said mixture comprising about 0.5 wt. % to about 1 wt. % nitromethane, based on the solvent mixture, about 0.5 wt. % to about 1 wt. % 1,2-butylene oxide, based on the solvent mixture, and the balance of said mixture of low boiling solvents being 1,3-dioxolane; and (c) the balance being at least one additive selected from the group consisting of sec-butanol, ethanol, and methanol, provided that sec-butanol comprises 0 wt. % to about 3 wt. % of said solvent mixture.

20. The solvent mixture of claim 19 comprising about 3.5 wt. % to about 5 wt. % of said mixture of low boiling solvents.

21. A method for cleaning an article having a surface in a vapor degreaser, said method comprising:

(a) providing a vapor degreaser system having a solvent reservoir;

(b) adding to the solvent reservoir of said vapor degreaser system a solvent mixture, said solvent mixture comprising:

i) about 85 wt. % to less than about 96.5 wt. % n-propyl bromide;

ii) about 3.5 wt. % to less than about 15 wt. % of a mixture of low boiling solvents, said mixture comprising about 0.5 wt. % to about 1 wt. % nitromethane, based on the solvent mixture, about 0.5 wt. % to about 1 wt. % 1,2-butylene oxide, based on the solvent mixture, and the balance of said mixture of low boiling solvents being 1,3-dioxolane; and iii) the balance being at least one additive selected from the group consisting of sec-butanol, ethanol, and methanol, provided that sec-butanol comprises 0 wt. % to about 3 wt. % of said solvent mixture;

(c) boiling said solvent mixture to form a vapor layer;

(d) introducing into said vapor layer said article to be cleaned, said vapor layer condensing on a surface of said article, thereby subjecting the surface of said article to a solvent-flushing action; and (e) removing said article from said vapor layer.

22. The method of claim 21 wherein said solvent mixture comprises about 3.5 wt. % to about 5 wt. % of said mixture of low boiling solvents.

* * * * *